United States Patent [19]

Hunnel

[11] 4,421,724

[45] Dec. 20, 1983

[54] EXTRACTION METHOD FOR REFRACTORY PRECIOUS METAL ORE

[75] Inventor: Larry B. Hunnel, Rathdrum, Id.

[73] Assignee: Anglo Mineral Resources, Inc., Beverly Hills, Calif.

[21] Appl. No.: 299,652

[22] Filed: Sep. 8, 1981

[51] Int. Cl.[3] ..... C01G 55/00; C01G 3/00; B01D 11/00; B01F 1/00

[52] U.S. Cl. ..... 423/22; 423/29; 423/31; 75/105; 75/118 R

[58] Field of Search ..... 423/22, 29, 30, 31; 75/105, 118 R, 121

[56] References Cited

U.S. PATENT DOCUMENTS

| | | | |
|---|---|---|---|
| 483,766 | 10/1892 | Moldenhauer | 423/29 |
| 4,038,362 | 7/1977 | Guay | 423/29 |

OTHER PUBLICATIONS

Chemical Abstracts, vol. 67, No. 4, 14684w.
Chemical Abstracts, vol. 67, No. 16, 76616.
Gold and Silver Cyanidation Plant Practice, McQuiston et al., 1975, pp. 19–25.
*Manual of Cyanidation,* Hamilton, 1920, pp. 1–9.
Encyclopedia of Science and Technology, McGraw-Hill, 5 Ed., p. 825, 1981.
Chemical Abstracts, vol. 70, No. 2, 6439s.
Chemical Abstracts, vol. 68, No. 24, 107721s.
Dorr & Bosqui, Cyanidation and Concentration of Gold and Silver Ores, 1950, pp. 210–211.

*Primary Examiner*—Gregory A. Heller
*Attorney, Agent, or Firm*—Donald Diamond

[57] ABSTRACT

Cyanic extraction of precious metal from comminuted, refractory precious metal ore as well as refractory precious metal concentrates and tailings from such ore is effected with rapidity and high yield by agitationally treating the refractory material with an aerated, alkaline solution containing a high concentration of water soluble cyanide and a low concentration of chemical oxidizer such as potassium permanganate.

12 Claims, No Drawings

EXTRACTION METHOD FOR REFRACTORY PRECIOUS METAL ORE

BACKGROUND OF THE INVENTION

This invention relates to hydrometallurgical processing of precious metal sources and, more particularly, to cyanic extraction of precious metal from refractory precious metal sources including ores, concentrates, and tailings.

As used herein, the term "precious metal" means gold, silver and platinum and the term "precious metal ore" includes precious metal concentrates and tailings derived from precious metal ore.

The cyanide process, also known as cyanidation, has long been used to extract gold from free milling gold ore. In the application of the cyanide process, a soluble, gold-cyanide complex is obtained by agitationally treating comminuted, free milling gold ore with an aerated, alkaline solution containing a low concentration of water soluble cyanide. In this process, aurum (gold) interacts with, for example, sodium cyanide in the presence of oxygen and water to produce sodium auricyanide (gold-cyanide complex) and sodium hydroxide.

In contrast to the free milling ores which are readily amenable to cyanidation without prior chemical conditioning, it is well known in the hydrometallurical art that other precious metal ores offer varying degrees of resistance to direct cyanidation. This resistance is manifested in some instances by unusually long extraction time and in other instances through "consumption" of cyanide and oxygen which results in reduced yield of solubilized gold.

Precious metal ores which resist cyanidation such as pyritic gold ore, arsenical gold ore and quartzitic gold ore are referred to in the art as refractory ores. A pyritic ore comprises metallosulfide as, for example, iron sulfide such as iron monosulfide and iron disulfide; an arsenical ore is typified by arsenopyrite which is chemically expressed as iron sulfarasenide; and a quartzitic ore comprises crystalline silicon dioxide. Sulfides of copper, iron, antimony and arsenic have been characterized as cyanicides because of their significant adverse effect on cyanide in respect of the degree of gold solubilization. It appears that various sulfide compositions have solubility characteristics which permit interaction with cyanide and oxygen to form, for example, ferrocyanide, cyanate and thiocyanate, all to the diminution of maximum gold extraction and recovery.

In order to place refractory precious metal ores in suitable form for effective and efficient cyanidation, it has been the practice to condition such ores prior to cyanidation by subjecting the ores to appropriate treatment. Examples of pre-cyanidation conditioning include (a) treatment of the ore with lime and air, (b) treatment of the ore with a chemical oxidizing system containing calcium hypochlorite, and (c) treatment of the ore by roasting. These procedures for effecting pre-cyanidation treatement are discussed in the Monograph entitled Gold And Silver Cyanidation Plant Practice by F. W. McQuiston and R. S. Shoemaker, The American Institute of Mining, Metallurical and Petroleum Engineers, Inc., 1975. It is suggested that the purpose of the conditioning step is to unlock or liberate the precious metal from the refractory ore and to covert any refractorizing constituent into a form which does not consume cyanide and/or oxygen.

Since prolonged extraction time and pre-cyanidation condition impose economic and technological burdens in the processing of refractory precious metal ore, it would be significantly advantageous to provide a method for effecting cyanic extraction of precious metal from refractory ore which would substantially increase the precious metal extraction rate and would eliminate the necessity for a pre-cyanidation conditioning step.

SUMMARY OF THE INVENTION

In accordance with this invention, there is provided a method for effecting cyanic extraction of precious metal from comminuted, refractory precious metal ore, which comprises:

agitationally treating said ore with an aerated, alkaline solution containing (a) water soluble cyanide in an amount from about 112 to about 336 grams of cyanide ion per gallon of solution and (b) chemical oxidizer in an amount from about 0.5 to about 10 grams per gallon of solution.

DETAILED DESCRIPTION

The refractory materials, namely, ores, concentrates and tailings which can advantageously be treated by the method of this invention include pyritic, arsenical and quartzitic precious metal materials which have been comminuted to a particle size less than 80 mesh, U.S. Standard Sieve Size (mesh is defined as the number of openings in a screen or classifier per linear inch). The fineness of the grind is determined by the ore being treated, with average particle size and particle size distribution being so selected as to provide an optimum extraction rate. Equipment for crushing and grinding ore is well known in the art and any suitable grinder may be used for obtaining appropriate particle size.

The unique aqueous, alkaline leaching solution of this invention contains a high concentration of water soluble cyanide and a low concentration of chemical oxidizer. Examples of water soluble cyanide which can be used in preparing the leaching solution include sodium cyanide, potassium cyanide, calcium cyanide and mixtures thereof. Water soluble cyanide is generally present in the solution in an amount from about 112 to about 336 grams of cyanide ion per gallon of solution and, preferably, in an amount from about 168 to about 280 grams of cyanide ion per gallon of solution. Chemical oxidizer is generally present in the solution in an amount from about 0.5 to about 10 grams per gallon of solution and, preferably, in an amount from about 0.6 to 8 grams per gallon of solution. Any suitable chemical oxidizer can be employed in the solution which has the effect of supplying solubilized oxygen for enhancing the rate of precious metal solubilization and, at the same time, converting refractorizing constituents such as sulfides and arsenides into substantially inert forms with respect to consumption of cyanide and air source oxygen. Examples of chemical oxidizers meeting these requirements include potassium permanganate, sodium permanganate, manganese dioxide and mixtures thereof. To facilitate solubility, the chemical oxidizer may be pre-dissolved in a small amount of water before being added to the alkaline solution. The pH of the alkaline solution should be at least about 10 and, preferably, from about 11 to about 13. The alkalinity of the solution can be adjusted, as required, by employing an alkali metal hydroxide such as sodium hydroxide or potassium hydroxide.

To effect precious metal extraction, refractory precious metal ore is agitationally treated with an aerated, alkaline solution containing water soluble cyanide and chemical oxidizer as hereinabove described. The weight per gallon ratio of ore to solution is generally from about 500 to about 10,000 grams of ore per gallon of solution. The temperature of the treating solution is, advantageously, from about 21° to about 50° C. Aeration should be sufficient to maintain the maximum amount of oxygen in the solution during the extraction step. The extraction can be carried out in a suitable reaction vessel equipped with mixing and aeration mechanisms. Commercial equipment, offering diverse design choices, is available for cyanic extraction. The agitational treatment is carried out for a sufficient length of time to obtain the economic optimum yield of solubilized precious metal as shown by appropriate chemical monitoring. The economic optimum yield is attained when there is a plateau in the precious metal concentration level over a specified time period.

Upon completion of the extraction step, the precious metal solution can be separated from the solids by filtration and the solubilized precious metal can then be removed from the filtrate by zinc displacement, by electrodeposition or by activated carbon adsorption. Precious metal, in final form, is obtained by further separation and refining treatment.

EXAMPLES

The following examples further illustrate the invention. Sulfide, arsenide and silica precious metal ores were treated with a relatively high concentration of cyanide and a low concentration of chemical oxidizer and the results were evaluated with respect to precious metal solubilization per unit time. Pursuant to the test procedure employed, each ore sample to be tested was crushed, pulverized and screened to minus 80 mesh. After thorough mixing, one pound of the comminuted ore was weighed out and added to a beaker which held 3 liters of leach solution containing 226.8 grams of sodium cyanide and 0.5 grams of potassium permanganate. The solution, which was agitated by a paddle connected to a stirring motor and aerated by means of a small compressor, was maintained at a temperature of 120° F. during the extraction step. The extraction solution at specified time intervals, was monitored for pH, millivolts, concentration of sodium cyanide and concentration of precious metals. The quantity of precious metals in the feed ore (head assay) and in the solids remaining after extraction (tail assay) was determined by atomic absorption using an IL Spectrophotometer. The head, tail and solution assay is reported as ounce(s) of precious metal per ton of material. Discrepencies between head, tail and solution assay are within sampling error.

EXAMPLE I

Five samples of a high silica precious metal ore having a silica content of 85.8% were separately treated in accordance with the above-described procedure and the results are set forth in Table I.

TABLE I

| Hour | Au/Ag Head Assay | pH | Mv | NaCN oz/gal | Au in soln. | Ag in soln. | Au/Ag Tails Assay | Soln., ml |
|---|---|---|---|---|---|---|---|---|
| 1A | | | | | | | | |
| start | .49/2.70 | 11.2 | −250 | 10.21 | | | | 3000 |
| 3rd | | 10.6 | −250 | 10.10 | .52 | 1.69 | | |
| 6th | | 11.4 | −350 | 10.06 | .55 | 1.72 | | |
| 24th | | 11.8 | −310 | 10.21 | .55 | 1.72 | | 2760 |
| | | | | | | | .04/.58 | |
| 1B | | | | | | | | |
| start | .72/2.09 | 11.6 | −340 | 9.90 | | | | 3000 |
| 3rd | | 11.8 | −310 | 9.52 | .58 | 1.69 | | |
| 6th | | 11.6 | −330 | 9.30 | .61 | 1.69 | | 2930 |
| | | | | | | | .02/.79 | |
| 1C | | | | | | | | |
| start | .78/2.46 | 11.7 | −450 | 9.47 | | | | 3000 |
| 3rd | | 11.6 | −390 | 9.33 | .61 | 1.72 | | |
| 6th | | 11.7 | −350 | 9.10 | .64 | 1.80 | | 2840 |
| | | | | | | | .02/.51 | |
| 1D | | | | | | | | |
| start | .68/2.36 | 11.7 | −360 | 9.50 | | | | 3000 |
| 3rd | | 11.8 | −310 | 9.52 | .52 | 1.78 | | |
| 6th | | 11.6 | −330 | 9.43 | .55 | 1.81 | | 2870 |
| | | | | | | | .00/.41 | |
| 1E | | | | | | | | |
| start | .41/2.48 | 11.6 | −330 | 9.43 | | | | 3000 |
| 3rd | | 11.5 | −330 | 9.62 | .61 | 1.63 | | |
| 6th | | 11.6 | −320 | 9.48 | .61 | 1.74 | | 2900 |
| | | | | | | | .00/.52 | |

EXAMPLE II

Five samples of a high sulfide precious metal ore having a sulfur content of 15.8% were separately treated in accordance with the above-described procedure and the results are set forth in Table II. The high sulfide ore, which was also high in lead, iron, and zinc as well as silver, was a galena ore obtained from the Yukon Territory. The general procedure was modified as follows: in the treatment of Sample 2A, 0.5 gram of potassium permanganate was added at the 5th hour and another 0.5 gram of potassium permanganate was added at the 8½ hour; and in the treatment of Sample 2B, 1 oz. of sodium cyanide solution and 0.5 gram of potassium permanganate were added at the 6th hour; and in the treatment of Samples 2C and 2E, 0.5 gram of potassium permanganate was added in each instance at the 8th hour.

TABLE II

| Hour | Au/Ag Head Assay | pH | Mv | NaCN oz/gal | Au in soln. | Ag in soln. | Au/Ag Tails Assay | Soln., ml |
|---|---|---|---|---|---|---|---|---|
| 2A | | | | | | | | |
| start | .00/41.47 | 11.6 | −100 | 9.65 | | | | 3000 |
| 2nd | | 11.5 | −300 | 9.59 | .09 | 1.54 | | |
| 5th | | 11.4 | −270 | 9.15 | .09 | 12.04 | | |
| 8th | | 11.3 | −200 | 9.56 | .09 | 12.63 | | |
| 24th | | 11.6 | −300 | 8.25 | .09 | 50.54 | | 2960 |
| | | | | | | | .00/21.20 | |
| 2B | | | | | | | | |
| start | .14/59.50 | 11.5 | −310 | 8.39 | | | | 3000 |
| 2nd | | 11.8 | −300 | 8.77 | .09 | 39.93 | | |
| 6th | | 11.9 | −350 | 8.19 | .09 | 59.61 | | |
| NaCN | | 11.7 | −460 | 9.23 | | | | |
| 8th | | 11.9 | −350 | 8.59 | .11 | 59.02 | | |
| 24th | | 11.9 | −340 | 8.19 | .29 | 74.65 | | 2920 |
| | | | | | | | .00/8.70 | |
| 2C | | | | | | | | |
| start | .12/64.50 | 11.9 | −250 | 8.39 | | | | 3000 |
| 4th | | 11.8 | −280 | 8.49 | .07 | 50.10 | | |
| 8th | | 11.7 | −360 | 8.69 | .14 | 94.15 | | |
| 24th | | 11.8 | −300 | 8.80 | .17 | 114.19 | | 2860 |
| | | | | | | | .00/17.32 | |
| 2D | | | | | | | | |
| start | .00/64.16 | 11.6 | −530 | 9.69 | | | | 3000 |
| 2nd | | 11.4 | −340 | 9.94 | .036 | 38.19 | | |
| 4th | | 11.3 | −310 | 10.02 | .06 | 45.14 | | |
| 8th | | 11.6 | −280 | 10.89 | .05 | 51.69 | | |
| 24th | | 11.3 | −260 | 10.12 | .065 | 60.38 | | 2960 |
| | | | | | | | .00/17.26 | |
| 2E | | | | | | | | |
| start | .17/27.18 | 11.4 | −340 | 9.49 | | | | 3000 |
| 2nd | | 11.7 | −380 | 9.69 | .20 | 49.37 | | |
| 4th | | 11.6 | −350 | 9.54 | .30 | 57.48 | | |
| 6th | | 11.7 | −350 | 9.70 | .32 | 62.30 | | |
| 8th | | 11.7 | −330 | 9.82 | .35 | 66.96 | | |
| 24th | | 11.6 | −330 | 9.87 | .34 | 64.80 | | 2840 |
| | | | | | | | .00/13.38 | |

EXAMPLE III

Five samples of an arsenical precious metal concentrate having an arsenic content of 4.5% were separately treated in accordance with the above-described procedure and the results are set forth in Table III. The general procedure was modified as follows: in the treatment of Sample 3A, 0.5 gram of potassium permanganate was added at the 2nd hour, and 60 grams of sodium cyanide solution together with 0.5 gram of potassium permanganate were added at the 4th hour.

TABLE III

| Hour | Au/Ag Head Assay | pH | Mv | NaCN oz/gal | Au in soln. | Ag in soln. | Au/Ag Tails Assay | Soln., ml |
|---|---|---|---|---|---|---|---|---|
| 3A | | | | | | | | |
| start | 32.70/8.75 | 11.8 | −400 | 8.80 | | | | 3000 |
| 2nd | | 11.9 | −380 | 7.74 | 47.60 | 10.80 | | |
| 4th | | 12.2 | −300 | 7.20 | 52.50 | 12.53 | | |
| 8th | | 11.9 | −340 | 8.80 | 53.62 | 12.53 | | |
| 24th | | 11.5 | −400 | 9.40 | 54.59 | 13.50 | | 2940 |
| | | | | | | | .32/2.04 | |
| 3B | | | | | | | | |
| start | 32.67/7.90 | 11.8 | −100 | 10.99 | | | | 3000 |
| 2nd | | 11.8 | −330 | 10.48 | 46.20 | 12.34 | | |
| 6th | | 11.7 | −380 | 10.50 | 56.13 | 13.69 | | |
| 8th | | 11.8 | −340 | 10.50 | 58.44 | 14.47 | | 2880 |
| | | | | | | | 7.29/21.29 | |
| 3C | | | | | | | | |
| start | 41.71/15.75 | 11.8 | −90 | 10.20 | | | | 3000 |
| 2nd | | 11.8 | −120 | 10.20 | 58.84 | 13.31 | | |
| 4th | | 11.7 | −100 | 10.20 | 59.79 | 14.27 | | |
| 6th | | 11.8 | −200 | 9.97 | 60.76 | 15.04 | | |
| 8th | | 11.8 | −380 | 10.32 | 63.27 | 15.04 | | 2940 |
| | | | | | | | .79/2.30 | |
| 3D | | | | | | | | |
| start | 49.06/3.76 | 11.6 | −400 | 10.96 | | | | 3000 |
| 2nd | | 11.8 | −360 | 9.82 | 42.43 | 12.34 | | |
| 4th | | 11.8 | −360 | 9.87 | 47.64 | 13.11 | | |
| 6th | | 11.8 | −260 | 9.47 | 49.96 | 15.23 | | |
| 8th | | 11.8 | −280 | 9.53 | 53.24 | 15.13 | | 2860 |

TABLE III-continued

| Hour | Au/Ag Head Assay | pH | Mv | NaCN oz/gal | Au in soln. | Ag in soln. | Au/Ag Tails Assay | Soln., ml |
|---|---|---|---|---|---|---|---|---|
| | | | | | | | 5.39/14.39 | |
| 3E | | | | | | | | |
| start | 54.25/20.42 | 11.8 | −580 | 9.58 | | | | 3000 |
| 2nd | | 11.7 | −360 | 9.71 | 53.20 | 16.20 | | |
| 4th | | 11.7 | −400 | 9.59 | 59.02 | 18.90 | | |
| 6th | | 11.8 | −380 | 9.60 | 67.10 | 20.40 | | |
| 8th | | 11.7 | −410 | 9.55 | 70.79 | 23.14 | | 2880 |
| | | | | | | | 4.06/12.03 | |

EXAMPLE IV 226.8 grams of an ore ground to a particle size less than 200 mesh were agitated for 48 hours in a leach solution containing 1.5 liters of water, 113.4 grams of sodium cyanide and 0.25 grams of potassium permanganate. A plateu in the gold concentration level in the extraction solution was reached at the 6th hour. The results of this study are set forth in Table IV. In this table, gold and silver are expressed as ounces per ton of feed material; iron and sulfur are expressed as weight percent except for solution concentration which is expressed as grams per liter; arsenic is expressed as parts per million except for solution concentration which is expressed as weight per liter; and thiocyanate solution concentration is expressed as grams per liter.

TABLE IV

| | Head | Tail | Solution |
|---|---|---|---|
| Gold, oz/ton | 0.385 | 0.014 | 0.38 |
| Silver, oz/ton | 1.570 | 0.305 | 1.23 |
| Iron, wt. % | 35.000 | 30.000 | 4.50 (g/l) |
| Sulfur, wt. % | 28.100 | 23.900 | 2.10 (g/l) |
| Arsenic, pts/million | 610.000 | 490.000 | 8.60 (mg/l) |
| Thiocyanate, g/l | — | — | 16.20 (g/l) |

EXAMPLE V 226.8 grams of an ore ground to a particle size less than 200 mesh were leached in accordance with the procedure described in Example IV. The ore treated in this example was derived from one geographic source while the ore treated in Example IV came from a different geographic source. As in Example IV, a plateu in the gold concentration level in the extraction solution was reached at the 6th hour. The results of this study are set forth in Table V.

TABLE V

| | Head | Tail | Solution |
|---|---|---|---|
| Gold, oz/ton | 0.030 | 0.001 | 0.035 |
| Silver, oz/ton | 0.090 | 0.060 | 0.110 |
| Iron, wt. % | 50.000 | 32.000 | 1.700 (g/l) |
| Sulfur, wt. % | 1.400 | 0.300 | 0.200 (g/l) |
| Arsenic, pts/million | 850.000 | 390.000 | 180.000 (mg/l) |

TABLE V-continued

| | Head | Tail | Solution |
|---|---|---|---|
| Thiocyanate, g/l | — | — | 2.400 (g/l) |

In view of the foregoing description and examples, it will become apparent to those of ordinary skill in the art that equivalent modifications thereof may be made without departing from the spirit and scope of this invention.

That which is claimed is:

1. A method for effecting cyanic extraction of precious metal from comminuted, refractory precious metal ore, which comprises:

agitationally treating said ore with an aerated, alkaline solution containing (a) water soluble cyanide in an amount from about 112 to about 336 grams of cyanide ion per gallon of solution and (b) chemical oxidizer in an amount from about 0.5 to about 10 grams per gallon of solution, wherein the weight per gallon ratio of ore to solution is from about 500 to about 10,000 grams of ore per gallon of solution.

2. The method of claim 1 wherein the ore comprises a pyritic precious metal ore.

3. The method of claim 1 wherein the ore comprises an arsenical precious metal ore.

4. The method of claim 1 wherein the ore comprises a quartzitic precious metal ore.

5. The method of claim 1 wherein the concentration of water soluble cyanide is from about 168 to 280 grams of cyanide ion per gallon of solution.

6. The method of claim 1 wherein the water soluble cyanide is sodium cyanide, potassium cyanide, calcium cyanide, or mixtures thereof.

7. The method of claim 1 wherein the concentration of oxidizer is from about 0.6 to 8 grams per gallon of solution.

8. The method of claim 1 wherein the oxidizer is potassium permanganate, sodium permanganate, manganese dioxide or mixtures thereof.

9. The method of claim 1 wherein the solution has a pH of at least about 10.

10. The method of claim 1 wherein the solution has a pH from about 11 to about 13.

11. The method of claim 1 wherein the solution is at a temperature from about 21° to about 50° C.

12. The method of claim 1 wherein the comminuted ore has particle size less than 80 mesh.

* * * * *